4/5/88 XR 4,735,264

United States Patent [19]

Burris, II et al.

[11] Patent Number: 4,735,264

[45] Date of Patent: Apr. 5, 1988

[54] HIGH PRESSURE GAUGE CARRIER

[75] Inventors: Wesley J. Burris, II; Vincent P. Zeller; Jon B. Christensen, all of Duncan; William H. Shoffner, Ryan, all of Okla.

[73] Assignee: Halliburton Company, Duncan, Okla.

[21] Appl. No.: 892,151

[22] Filed: Jul. 30, 1986

[51] Int. Cl.[4] ..... E21B 41/00; E21B 47/06

[52] U.S. Cl. ..... 166/242; 73/431; 175/40; 166/64

[58] Field of Search ..... 166/264, 64, 162, 163, 166/242, 243; 73/431, 151, 430; 175/40, 50, 320

[56] References Cited

U.S. PATENT DOCUMENTS

| | | | |
|---|---|---|---|
| 2,658,284 | 11/1953 | Arps | 73/151 X |
| 2,869,363 | 1/1959 | Garrison | 73/151 |
| 3,109,693 | 11/1963 | Clements et al. | 73/151 X |
| 3,149,490 | 9/1964 | Clements et al. | 73/151 |
| 3,714,831 | 2/1973 | Quichaud et al. | 73/431 |
| 3,874,241 | 4/1975 | Harland et al. | 73/431 X |
| 4,413,516 | 11/1983 | Croom, Jr. et al. | 73/151 X |

*Primary Examiner*—Stephen J. Novosad

*Attorney, Agent, or Firm*—James R. Duzan; Joseph A. Walkowski

[57] ABSTRACT

The high pressure gauge carrier of the present invention uses an outer gauge carrier housing having disposed therein a pressure-tight inner housing carrying a temperature gauge in the interior thereof. The inner housing is substantially filled with a compressible liquid, and the pressure tight connections of the inner housing incorporated metal to metal seals in order to eliminate the failure of elastomeric seals at the elevated temperatures encountered by the gauge carrier.

10 Claims, 1 Drawing Sheet

HIGH PRESSURE GAUGE CARRIER

BACKGROUND OF THE INVENTION

It is common practice in the oil and gas industry to conduct temperature measurements during the drilling of a well to acquire data relating to both the bottom hole static temperature and the bottom hole circulating temperature of the well to properly plan and ensure the successful completion of a subsequent cementing operation wherein a tubular conduit, generally referred to as "casing," is cemented into the well bore. As temperature is a critical factor in the type of cement and additives employed in a particular operation, as well as in the setting time of the cement, such data is extremely important to the well operator.

There are two ways in which this temperature data is normally acquired. First, a mechanical or electronic temperature gauge may be incorporated into the bottom of the string of drill pipe through use of a gauge carrier. The second alternative is to deploy a wireline having a temperature transducer at the bottom thereof into the well bore. As oil wells are cemented deeper, however, the hydrostatic pressures encountered at the bottom of these deep wells exceed the limits of available temperature gauges and wireline equipment. As a result, bottom hole circulating and bottom hole static temperature data acquisition efforts needed to complete a successful cement job quite often end with the failure of the temperature gauge or wireline equipment employed, with a resulting lack of necessary data. Thus it became apparent to the inventors of the invention disclosed and claimed herein that a solution to this dilemma must be found.

SUMMARY OF THE INVENTION

The high pressure gauge carrier of the present invention uses an outer gauge carrier housing having disposed therein a pressure-tight inner housing carrying a temperature gauge in the interior thereof. The inner housing is substantially filled with a compressible liquid, and the pressure tight connections of the inner housing incorporate metal to metal seals in order to eliminate the failure of elastomeric seals at the elevated temperatures encountered by the gauge carrier. The compressible liquid inside the inner housing with the temperature gauge serves two purposes. First, the liquid functions effectively as a medium to transmit heat from the well fluid surrounding the inner housing to the temperature gauge therein. Second, by filling the inner housing with a compressible liquid the differential pressure between the exterior of the inner housing and the interior thereof and the temperature gauge is significantly reduced, as the compressible liquid expands and pressurizes the inner case due to the increase in temperature as the gauge carrier on the pipe string goes deeper into the well bore.

BRIEF DESCRIPTION OF THE DRAWINGS

The high pressure gauge carrier of the present invention will be more fully understood by a review of the following detailed description of the preferred embodiment, taken in conjunction with the accompanying drawing, wherein.

DETAILED DESCRIPTION OF THE PREFERRED EMBODIMENT

Figure 1A:
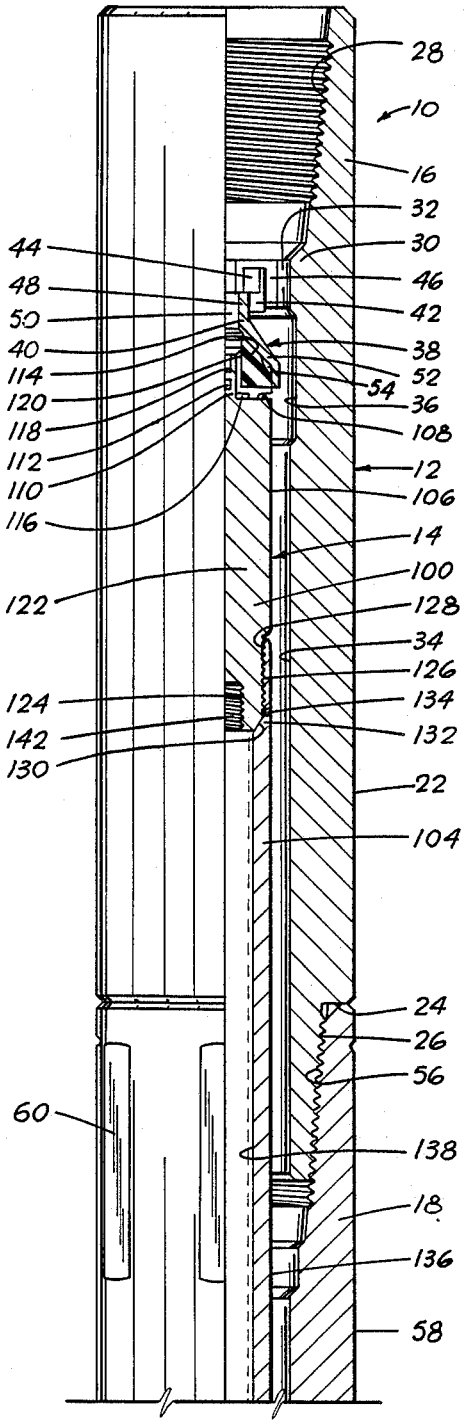
FIGS. 1A and 1B of the drawing depict a quarter section vertical elevation of the preferred embodiment of the high temperature gauge carrier of the present invention.
Figure 1B:
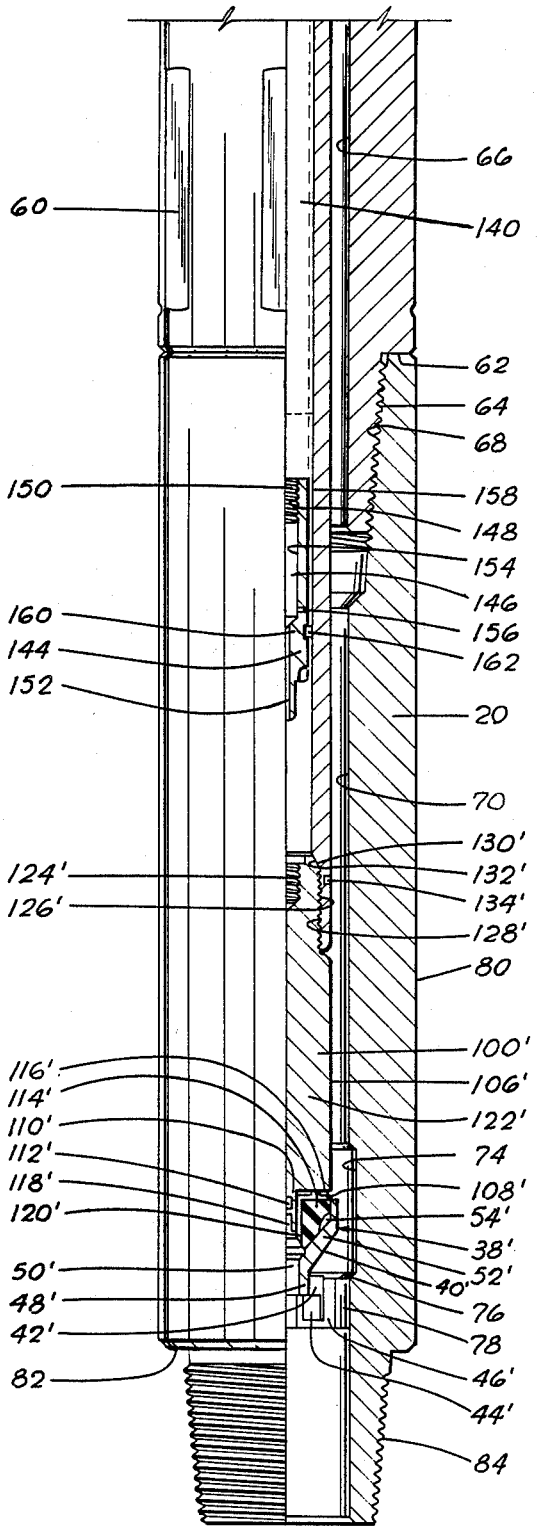

Referring to FIGS. 1A and 1B of the drawings, the high pressure gauge carrier 10 of the present invention comprises a substantially tubular outer housing 12 in which is substantially concentrically disposed a second, inner housing 14.

Outer housing 12 includes three major components: an upper case 16, a spacer 18, and a lower case 20. Upper case 16 includes a generally cylindrical exterior surface 22, which terminates at its lower end at radially inwardly extending annular shoulder 24, leading to trailing external threads 26. The interior of upper case 16 includes threaded entry bore 28 by which gauge carrier 10 may be suspended from a string of drill pipe thereabove. Below entry bore 28, annular support shoulder 30 extends radially inwardly to cylindrical spider support wall 32. Below shoulder 30 lies cylindrical bore 34 having annular recess 36 at the upper end thereof.

Upper support spider 38 is disposed adjacent shoulder 30 and recess 36 on the interior of upper case 16. Support spider 38 includes a central body 40 having a plurality of legs 42 extending radially outwardly therefrom to wall 32, whereat longitudinally extending feet 44 contact wall 32 and are secured thereto by welds 46. Legs 42, of which there are preferably three, are substantially equally spaced at 120° angles from body 40, defining apertures therebetween to permit well fluid to pass between outer housing 12 and inner housing 14. Body 40 includes an upper central collar 48 having a central bore 50 extending therethrough, below which downwardly and outwardly extending cone shaped bumper support 52 defines a frustoconical recess 54 having an open lower end.

Tubular spacer 18 is secured to the lower end of upper case 16 via threaded entry bore 56 which engages external threads 26 at the lower end of case 16, spacer 18 abutting shoulder 24 on upper case 16. The exterior of spacer 18 is defined by substantially cylindrical surface 58 having flats 60 thereon, the latter of which help in the making up of spacer 18 to upper case 16 and lower case 20. At the bottom of cylindrical surface 58, inwardly extending annular shoulder 62 leads to trailing external threads 64. The interior of spacer 18 below threaded entry bore 56 is defined in major part by cylindrical spacer bore wall 66.

Lower case 20 is secured to spacer 18 through the engagement of threaded entry bore 68 at the top of case 20 with threads 64 at the lower end of spacer 18, lower case 20 abutting shoulder 62 on spacer 18. Cylindrical bore 70 having recess 74 at the lower end thereof lies below threaded entry bore 68, which terminates adjacent inwardly extending chamfered surface 76 leading to cylindrical lower spider support surface 78, the latter of which extends to the bottom of carrier 10, defining an exit bore therefor.

The lower support spider 38', although facing upwardly rather than in a downward direction, is in all other respects substantially identical to upper support spider 38, and therefore identical reference numerals have been employed with respect thereto. Downwardly extending feet 44' on lower support spider 38' are, of course, welded via welds 46' to lower spider support surface 78 in this instance.

The exterior of lower case 20 is defined at its upper extent by substantially cylindrical outer surface 80, leading to inwardly extending radially oriented annular shoulder 82, below which external threads extend to the bottom of gauge carrier 10, by which it can be made up to a string of drill pipe therebelow.

Inner housing 14, disposed substantially concentrically within outer housing 12, is also substantially tubular in form. Inner housing 14 comprises, in major part, an upper high pressure plug 100, a lower high pressure plug 100', and a tubular gauge case 104 extending longitudinally therebetween and secured to both, case 104 defining a chamber for receiving a gauge therein. Upper plug 100 has a substantially cylindrical exterior surface 106 having wrench flats thereon. Above cylindrical surface 106 lies radially flat annular bumper shoulder 108, surrounding upwardly extending cylindrical nose 110 having axial blind bore 112 drilled therein.

A conical bumper assembly 114 including an elastomeric bumper element and having a central axial bore extending therethrough is disposed about nose 110 at the top of upper plug 100, and rests on shoulder 108. Metallic collar 116 having a radially extending flange at the bottom thereof extends upwardly into the bore of the bumper element and is bonded thereto. Retaining screw 118 is threaded into blind bore 112 at the top of upper plug 100, thereby securing bumper retention washer 120 thereto, washer 120 extending outwardly over the top of collar 116 and thereby maintaining bumper assembly 114 on nose 110 of upper plug 100. The major central portion 122 of upper plug 100 is solid, and is pierced only at its lower end by upwardly extending threaded blind gauge bore 124. The lower exterior of upper plug 100 includes threaded surface 126 thereon, by which gauge case 104 is secured thereto by internal threads 128. The trailing edge 130 of upper plug 100 is polished and of a frustoconical configuration, and cooperates with polished frustoconical seal bore 132 on the interior of gauge cas 104 below internal threads 128 to form a pressure-tight metal to metal seal. At least one vent port 134, which extends through the wall of gauge case 104 interposed between threaded bore 128 and seal surface 132, ensures that upper plug 100 can be easily made up to gauge case 104, and that no pressure will be trapped between the threaded connection therebetween and the metal to metal seal effected by the cooperation of trailing edge 130 and seal bore 132. The exterior of gauge case 104 comprises a generally cylindrical surface 136, surface 136 having wrench flats at the top and bottom thereof to facilitate securing of gauge case 104 to upper plug 100 and lower plug 100'. The interior of gauge case 104 is also substantially cylindrical throughout its major portion, being defined by bore wall 138. The lower end of gauge case 104 is substantially identical to the upper end thereof, possessing an internally threaded bore 128' and a lower seal bore 132', with at least one radial port 134' extending through the wall of gauge case 104 interposed therebetween.

Lower plug 100' is substantially identical to upper plug 100, except its orientation as a part of inner housing 14 is reversed 180° from that of upper plug 100. A metal to metal seal is effected between the lower end of gauge case 104 and the upper end of lower plug 100' by cooperating seal bore 132' and edge 130'. Likewise, lower bumper assembly 114', including an elastomeric element and a metal collar 116', is substantially identical to upper bumper assembly 114 with associated collar 116. Lower bumper assembly 114' is likewise secured to lower plug 100' via a retainer screw 118' and washer 120', these being substantially identical to screw 118 and washer 120 associated with upper plug 100'.

Inside inner housing 14, a temperature gauge such as (by way of example and not limitation) the BT or RT-7 temperature recorders, employed by Halliburton Services and described in Halliburton Services Sales and Service Catalog No. 43 at page 2535, is depicted in phantom by broken lines and identified by reference numeral 140 and the broken lead line associated therewith. Gauge 140 is secured in inner case 14 via threaded nose 142 at the top thereof, which engages threaded gauge bore 124 of upper plug 100. Of course, other well known connection means may be employed, such as lugs or keys.

The lower end of temperature gauge 140 is preferably secured to extension 144 having bore 146 extending therethrough, the upper end of which 148 is threaded and engages an externally threaded tail 150 on gauge 140. The lower portion 152 of bore 156 is substantially smaller than the upper portion 154 thereof, and immediately adjacent the juncture of the two bore portions, a plurality of radial ports 156 extend outwardly through the wall of extension 144 between bore 146 and the exterior surface 158 thereof. Exterior 158 includes an annular groove 160 therein slightly below ports 156, in which a seal ring 162, preferably of filled Teflon, is disposed to act in centralizing the lower end of gauge 140 in housing 14, and to assist in cushioning gauge 140 against lateral shocks.

When it is desired to use temperature gauge 140 to measure the bottom hole static or circulating temperature in a deep, hot well of the previously mentioned type which may cause conventional equipment to fail, gauge 140 is prepared according to conventional procedure, the timer therein is set and started, and gauge 140, with extension 144 secured to the lower end thereof, is lowered into inner housing 14 by upper plug 100, to which gauge 140 is secured at its top. The interior of inner housing 14 will have been previously partially filled with a compressible liquid such as silicone oil. As gauge 140 with extension 144 attached thereto is lowered into gauge case 104 of inner housing 14, silicone oil therebelow is displaced through the lower portion 152 of extension bore 146 to the exterior of extension 144 above seal 162, bypassing the latter and filling housing 14 about the exterior of gauge 140. Excess silicone oil is placed in inner housing 14, so that when temperature gauge 140 is fully inserted therein, and upper plug 100 by which gauge 140 is lowered into gauge case 104 is threaded to the top of gauge case 104, excess oil will be displaced through ports 126 at the top of gauge case 104, a metal to metal seal being effected between upper plug 100 and gauge case 104 via trailing edge 130 and seal bore 132 immediately therebelow. In such a manner, it is ensured that substantially all of the air in inner housing 14 has been removed. In some instances where the gauge carrier 10 is to be deployed in an extremely hot or deep well, a slight amount of air may be intentionally left inside inner housing 14. This air will compress to a negligible volume before the compressible liquid begins to exert significant pressure on the inside of inner housing 14 due to temperature induced expansion, thus preventing that pressure from acting on inner housing 14 before there is sufficient hydrostatic pressure outside of housing 14 to balance the inside pressure and prevent inner housing 14 from bulging or otherwise distorting.

Inner housing 14, with temperature gauge 140 secured therein, is then lowered into outer housing 12 with upper case 16 removed therefrom, until lower bumper assembly 114 rests on lower support spider 38'. Upper case 16 is then lowered over the upwardly extending top of inner housing 14 protruding above spacer 18, and is made up thereto so that inner housing 14 is held between upper support spider 38 and lower support spider 38' of outer housing 12, bumper assemblies 114 and 114' acting as shock absorbers between the inner and outer housings. Collars 116 and 116' permit relatively free rotation during the making up of upper case 16 and the previously assembled spacer 18 and lower case 20 without the risk of partially backing off the threaded connections in inner housing 14, and the breaking of the metal to metal seals associated therewith.

Fully assembled gauge carrier 10 is then included in a string of drill pipe, and is gradually lowered to the bottom of the well bore as stands of pipe are added thereabove. Gauge carrier 10 with gauge 140 therein is subsequently retrieved from the well, and the data acquired by gauge 140 is employed in planning the subsequent cementing operation. While in the well bore, well fluids can be freely circulated between outer housing 12 and inner housing 14 due to the use of upper and lower support spiders 38 and 38' respectively, which provide passage for the well fluids about inner housing 14 and between the exterior thereof and the inner wall of outer housing 12.

While disposed in the well bore, temperature gauge 140 is protected from pressure by inner housing 14 with its upper and lower metal to metal seals between case 104 and upper and lower plugs 100 and 100', respectively. Gauge 140 is centralized inside inner housing 14 by extension 144 and its associated seal 162, the latter of which, as previously mentioned, also acts as a cushion against lateral shock. Moreover, the filling of inner housing 14 with a compressible liquid and the expulsion of air therefrom befor closing of housing 14 provides support for the inner housing 14 from within, as the compressible liquid increases (slightly) in volume and, therefore, pressure as the temperature of carrier 10 increases as it travels deeper in the well bore. This pressure increase lessens the differential pressure between the inside and the outside of case 14, relieving some stress thereon by the hydrostatic pressure of the fluids in the well bore. Furthermore, the liquid acts as a damper to vibration of gauge 140 inside housing 14. Finally, the presence of the compressible liquid acts as an efficient medium for the transfer of heat from the exterior of inner housing 14 to the interior thereof and so to the transducer incorporated in temperature gauge 140 by which the temperature of the well bore, both in a static and a circulating mode, may be measured. Upper and lower bumper assemblies 114 and 114', respectively, act as cushions against longitudinal shock to gauge 140 through housing 14, and also act as bearings permitting the making up of outer housing 12 without the backing off of any of the threaded connections between the components of inner housing 14.

Thus it is apparent that a novel and unobvious high pressure gauge carrier has been invented. While the present invention has been described in terms of a preferred embodiment, it will be apparent to those of ordinary skill in the art that the invention is not so limited. For example, the use of cooperating inner and outer housings could be employed in a gauge carrier of different configuration, such as a bundle carrier in which a plurality of inner housings containing gauges are disposed about or adjacent to a central or offset bore running through the outer housing of the carrier; the shock absorbing mechanism could be changed; more than one gauge might be placed in an inner housing; the bumper assemblies could be incorporated in the outer housing; and others. Such modifications and other additions, deletions and modifications to the invention as described in the preferred embodiment may be made without departing from the spirit and scope of the claimed invention.

We claim:

1. A gauge carrier for disposition in a well bore, said gauge carrier comprising:

an inner pressure-tight housing having a chamber therein adapted to receive at least one gauge;

an outer housing including support means for said inner housing therein; and a compressible liquid substantially filling any space in said chamber unfilled by said gauge.

2. The apparatus of claim 1, wherein said inner housing has an openable end connection, said connection including a metal to metal pressure seal.

3. A high pressure gauge carrier for running a gauge into a well bore, said high pressure gauge carrier comprising:

an outer housing;

longitudinally spaced upper and lower support means in said outer housing adapted to engage and support a tubular inner housing;

a tubular inner housing having a pressure-tight chamber therein for receiving said gauge, said inner tubular housing having bumper means at the upper and lower ends thereof for engagement by said support means of said outer housing; and compressible liquid, such as compressible silicone oil, filling any voids in said tubular inner housing and between said tubular inner housing and said outer housing.

4. A high pressure gauge carrier for running at least one gauge into a well bore, said high pressure gauge carrier comprising;

an outer housing;

longitudinally spaced upper and lower support means in said outer housing adapted to engage and support tubular inner housing; and a tubular inner housing having a pressure-tight chamber therein for receiving said at least one gauge, said inner housing having bumper means at the upper and lower ends thereof for engagement by said support means of said outer housing, said tubular inner housing including:

a tubular case defining said chamber and having at least one open end;

at least one end plug adapted to close off said at least one open end and cooperating metal sealing surfaces at said at least one open end and said at least one end plug, wherein said at least one gauge is secured at one end to said at least one end plug, the other end of said at least one gauge being secured to an extension means adapted to be received inside said tubular case chamber and including centralizing means disposed thereabout and adapted to extend between said extension means and the interior of said tubular case.

5. The apparatus of claim 4, wherein said at least one gauge is threaded to one end of said extension means, said extension means includes an axial bore therethrough, and further includes port means located between said gauge and said centralizing means and extending through the wall of said extension means between the axial bore and the exterior thereof.

6. A high pressure gauge carrier for running a gauge into a well bore, said gauge carrier comprising:

a tubular outer housing;

longitudinally spaced upper and lower support means in said outer housing adapted to engage and support an inner housing, said upper and lower support means of said outer housing each comprising a support spider, each said spider including, in turn, a central collar having laterally oriented circumferentially spaced legs extending therefrom and secured to the interior of said outer housing, said collar including, in turn, bumper engagement means thereon; and a tubular inner housing having a pressure-tight chamber therein for receiving said gauge, said inner housing having bumper means at the upper and lower ends thereof for engagement by said support means of said outer housing wherein said bumper engagement means comprise frustoconical recesses, and said bumper means comprise bumper assemblies including elastomeric bumpers thereon receivable in said recesses, said bumper assemblies being rotatably secured on the upper and lower ends of said inner housing, whereby said inner housing extends longitudinally between said support means in said outer housing.

7. The apparatus of claim 6, wherein said inner housing is substantially concentrically disposed in said outer housing.

8. The apparatus of claim 7, wherein said inner housing includes:

a tubular case defining said chamber and having at least one open end;

at least one end plug adapted to close off said at least one open end; and cooperating metal sealing surfaces at said at least one open end and on said at least one end plug.

9. The apparatus of claim 8, wherein said at least one gauge is secured at one end to said at least one end plug, the other end of said at least one gauge being secured to an extension means adapted to be received inside said tubular case chamber and including centralizing means disposed thereabout and adapted to extend between said extension means and the interior of said tubular case.

10. The apparatus of claim 9, wherein said at least one gauge is threaded to one end of said extension means, said extension means includes an axial bore therethrough, and further includes port means located between said gauge and said centralizing means and extending through the wall of said extension means between the axial bore and the exterior thereof.

* * * * *